US005787614A

United States Patent [19]

Stützer

[11] Patent Number: 5,787,614

[45] Date of Patent: Aug. 4, 1998

[54] ELECTRIC STEAM IRON WITH AEROSOL SPRAYER

[75] Inventor: Franz Alban Stützer, Offenbach am Main, Germany

[73] Assignee: Rowenta-Werke GmbH, Offenbach A.M., Germany

[21] Appl. No.: 725,198

[22] Filed: Sep. 16, 1996

[30] Foreign Application Priority Data

Mar. 30, 1993 [DE] Germany ..... 43 10 273.5
Mar. 3, 1994 [WO] WIPO ..... PCT/DE94/00232

[51] Int. Cl.[6] ..... D06F 75/22
[52] U.S. Cl. ..... 38/77.1
[58] Field of Search ..... 38/77.1, 77.5, 38/77.83, 93, 77.3; 219/245

[56] References Cited

U.S. PATENT DOCUMENTS

| | | | |
|---|---|---|---|
| 277,193 | 5/1883 | Ball | 38/93 |
| 1,110,537 | 9/1914 | Durand | 38/77.1 |
| 1,537,916 | 5/1925 | Black | 38/77.1 X |
| 2,634,525 | 4/1953 | McGraw | 38/77.3 |
| 2,802,288 | 8/1957 | Hoecker | 38/77.5 |
| 3,002,302 | 10/1961 | Flowers | 38/77.5 |
| 3,534,488 | 10/1970 | Hardwick et al. | 38/77.3 |
| 4,685,229 | 8/1987 | Moravek et al. | 38/93 X |

*Primary Examiner*—Ismael Izaguirre
*Attorney, Agent, or Firm*—Cohen, Pontani, Lieberman & Pavane

[57] ABSTRACT

An electric iron including an electrically heated soleplate having a pressing surface. The soleplate being configured so as to form and enclose an atomization chamber in a frame-like manner which is open toward the pressing surface of the soleplate. The electric iron further has a spraying device provided in the soleplate which spraying device includes at least one outlet opening arranged to open into the atomization chamber.

8 Claims, 2 Drawing Sheets

ELECTRIC STEAM IRON WITH AEROSOL SPRAYER

This is a continuation application under 35 U.S.C. §111 and 37 C.F.R. §1.53 of International PCT application No. PCT/DE94/00232 which was filed on Mar. 3, 1994, published as publication No. WO 94/23111 on Oct. 13, 1994, and claims priority from German application No. P 43 10 273.5 filed Mar. 30, 1993.

BACKGROUND OF THE INVENTION

1. Field of the Invention

The invention is directed to an electric iron with an electrically heated soleplate and an aerosol spray device.

2. Description of the Prior Art

In order to achieve optimum ironing results it is known to iron with hot steam or to moisten the article to be ironed with water prior to ironing either by hand or by means of a spray device which is provided at the iron.

Known steam irons evaporate water by means of the heating element which is provided for normal ironing in a steam chamber provided especially for this purpose. The water is admitted to the steam chamber by drops via a valve and, after evaporating, exits the soleplate through ducts which are provided for this purpose. In order to heat and evaporate the water, considerable electrical power is required which is not made available for the actual ironing process and causes unnecessary costs. It is also known that good ironing results can be achieved by moistening the article to be ironed with a water-air aerosol combined with heat. Further, aerosol sprayers which work without pressure and in which an ultrasonic generator is vibrated by means of a piezoceramic element are known. The spraying of cold water via the known steam ducts at the pressing surface of the soleplate is not possible with aerosol sprayers of this kind, since the pressing of the iron against the article to be ironed and the density of the fabric impede the exit of the aerosol during ironing.

SUMMARY OF THE INVENTION

Based on the known prior art, the object of the present invention is to provide an iron which does not have the disadvantages of known steam irons and in which the known thermal evaporation is replaced by a mechanical atomization of water.

Pursuant to this object, and others which will become apparent hereafter, one aspect of the present invention resides in an electric iron having an electrically heated soleplate with a pressing surface, the soleplate being configured so as to form and enclose an atomization chamber in a frame-like manner, which chamber is open towards the pressing surface, and a spring device provided in the soleplate and having at least one outlet opening arranged to open into the atomization chamber.

As a result of the soleplate, according to the invention, which encloses an atomization chamber in a frame-like manner and in which a mechanical spraying device is arranged, the iron according to the invention can be advantageously outfitted with an aerosol spraying device which operates without pressure, e.g., a piezoceramic element which is vibrated by an ultrasonic-frequency generator. Owing to the low electrical power requirement for such mechanical atomization devices, the heating element in the soleplate can be substantially smaller than in known steam irons. The calcification or furring of the steam chamber and steam ducts familiar in steam irons is also eliminated which prolongs the service life of the iron according to the invention. The horseshoe-shaped, oval or round soleplate encloses the atomization chamber in a frame-like manner so that the pressing surface of the soleplate can be substantially reduced compared with known soleplates. The material requirements and production costs for the soleplate are accordingly extremely low. When ironing, the article to be pressed is first advantageously moistened via the spraying device and is then smoothed by the hot soleplate so that the moisture can penetrate deeper into the article to be ironed and does not evaporate already at the surface as in the known steam irons.

An embodiment example of the invention is shown in FIGS. 1 to 5 and is explained more fully in the following.

DETAILED DESCRIPTION OF THE PREFERRED EMBODIMENTS

Figure 1:
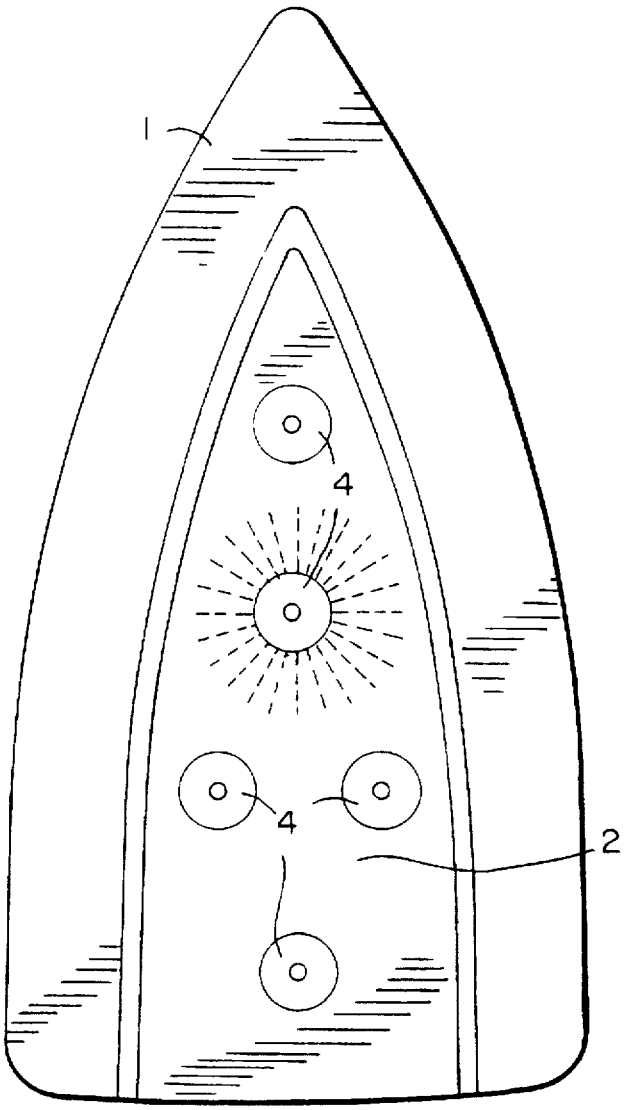
FIG. 1 is a bottom view of the soleplate according to the invention.
Figure 3:
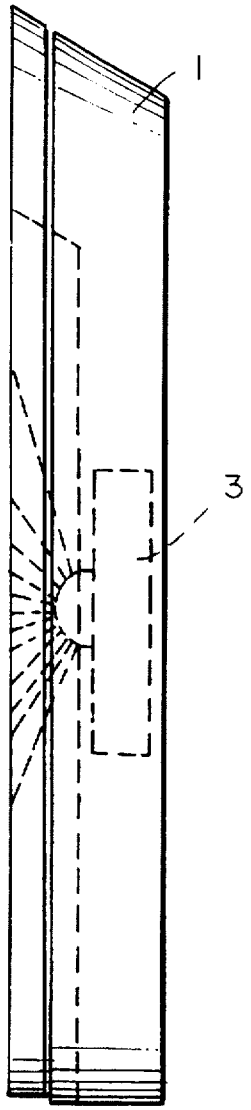
FIG. 3 is a longitudinal section through the soleplate FIG. 1.
Figure 2:
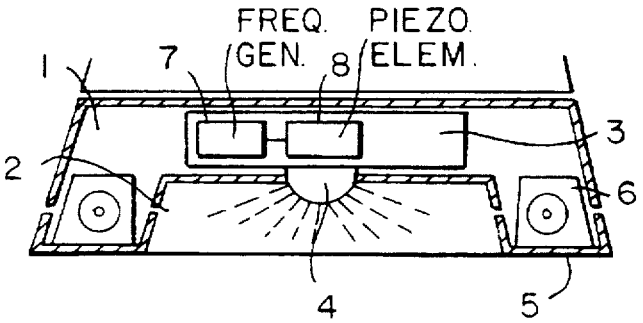
FIG. 2 is a cross section through the soleplate FIG. 1.
Figure 4:
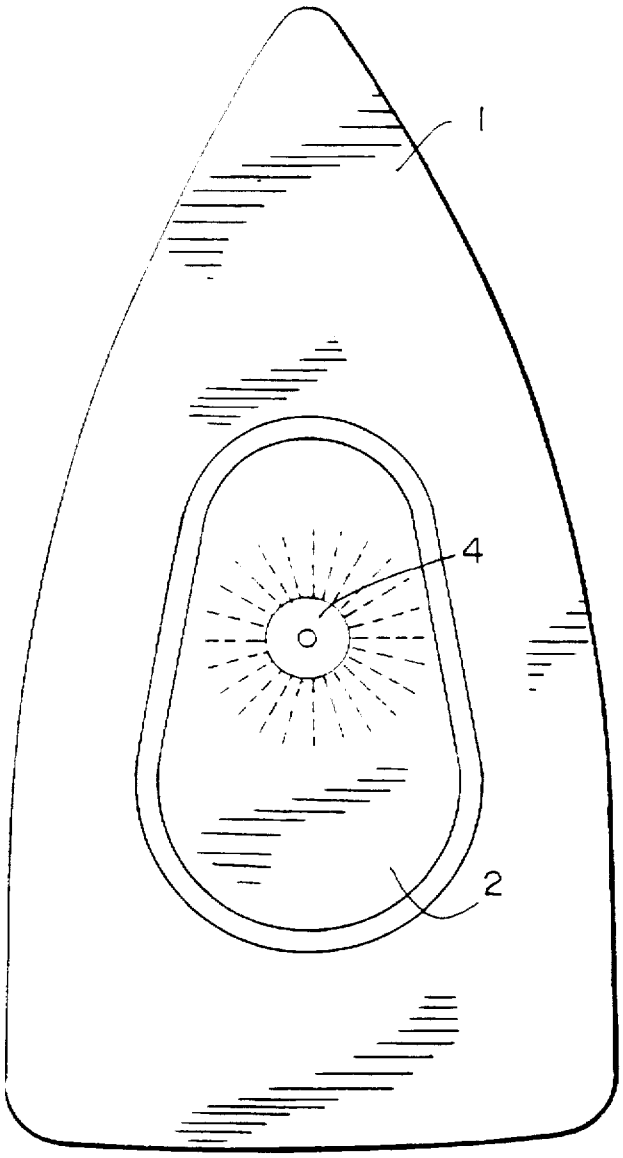
FIG. 4 is a bottom view of another embodiment of the soleplate according to the invention.
Figure 5:
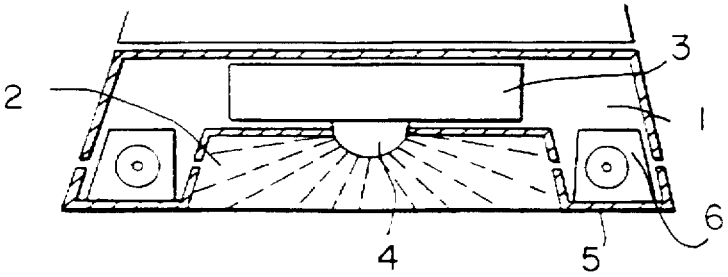
FIG. 5 is a cross section through the soleplate FIG. 4.

The soleplate 1 of an iron, not shown, is constructed in an almost horseshoe-shaped manner as is shown in FIGS. 1 to 3 and the soleplate 1 encloses an atomization chamber 2 in a frame-like manner. The atomization chamber 2 is constructed so as to be open toward the pressing surface. The spray nozzle 4 of an air/cold-water spraying device 3 such as an aerosol or atomizing device, opens out into the atomization chamber 2. As previously mentioned, the spraying device 3 can include a piezoceramic element 8 that is vibrated by an ultrasonic-frequency generator 7. The pressing surface 5 of the soleplate 1 is electrically heated by a heating element 6. The atomization chamber 2 is constructed so as to be open at the rear. In the embodiment shown in FIGS. 4 and 5, soleplate 1 is configured so that the atomization chamber 2 is closed at the rear.

I claim:

1. An electric iron, comprising:

an electrically heated soleplate having a pressing surface, the soleplate defining an area and being configured so as to form and peripherally enclose an atomization chamber which is open toward the pressing surface and occupies a substantial portion of the soleplate area; and an aerosol spraying device operable without pressure and having at least one outlet opening, the spraying device being arranged in the soleplate so that the at least one outlet opening opens into the atomization chamber.

2. An electric iron according to claim 1, wherein the at least one outlet opening of the spraying device includes a plurality of outlet openings arranged to form a nozzle.

3. An electric iron according to claim 1, wherein the at least one outlet opening of the spraying device includes a plurality of outlet openings arranged over a surface area of the atomization chamber.

4. An electric iron according to claim 1, wherein the soleplate is configured so that the atomization chamber is open at a rear end of the soleplate.

5. An electric iron according to claim 1, wherein the soleplate is configured so as to completely surround the atomization chamber.

6. An electric iron according to claim 1, wherein the spraying device includes a piezoceramic element and ultrasonic-frequency generating means for vibrating the piezoceramic element.

7. An electric iron according to claim 1, and further comprising means for electrically heating the soleplate.

8. An electric iron according to claim 7, wherein the heating means includes an electric heating element arranged in the soleplate beneath the pressing surface.

* * * * *